US009246248B2

(12) United States Patent
Martens et al.

(10) Patent No.: US 9,246,248 B2
(45) Date of Patent: Jan. 26, 2016

(54) MOTOR VEHICLE POWER CONDUCTOR HAVING A METALLIC FLAT CONDUCTOR ENCLOSED BY AN INSULATION AND A BENT JUMP-START CONNECTION POINT

(71) Applicant: Auto-Kabel Management GmbH, Hausen i.W. (DE)

(72) Inventors: Sebastian Martens, Straelen (DE); Thomas Zang, Hürth (DE)

(73) Assignee: Auto-Kabel Management GmbH, Hausen i. W. (DE)

( * ) Notice: Subject to any disclaimer, the term of this patent is extended or adjusted under 35 U.S.C. 154(b) by 0 days.

(21) Appl. No.: 14/414,328

(22) PCT Filed: Jul. 31, 2013

(86) PCT No.: PCT/EP2013/066072

§ 371 (c)(1),
(2) Date: Jan. 12, 2015

(87) PCT Pub. No.: WO2014/023624

PCT Pub. Date: Feb. 13, 2014

(65) Prior Publication Data

US 2015/0180144 A1 Jun. 25, 2015

(30) Foreign Application Priority Data

Aug. 6, 2012 (DE) ..... 10 2012 015 350

(51) Int. Cl.

| | |
|---|---|
| ***H01R 11/28*** | (2006.01) |
| ***F02N 11/14*** | (2006.01) |
| *F02N 11/08* | (2006.01) |

(52) U.S. Cl.
CPC ..... *H01R 11/288* (2013.01); *F02N 11/14* (2013.01); *F02N 11/0866* (2013.01)

(58) Field of Classification Search
CPC ..... H01R 11/24; H01R 11/288; H01R 11/32
USPC ..... 439/503, 504, 754
See application file for complete search history.

(56) References Cited

U.S. PATENT DOCUMENTS 4,662,696 A * 5/1987 Asbury ..... H01H 9/0228 439/504
4,721,479 A * 1/1988 Shuman ..... H01R 13/71 439/503

(Continued)

FOREIGN PATENT DOCUMENTS

CN 101128888 A 2/2008 ..... H01B 7/00
CN 101821132 A 9/2010 ..... B60R 16/02

(Continued)

OTHER PUBLICATIONS

International Searching Authority, International Search Report—International Application No. PCT/EP2013/066072, dated Oct. 22, 2013, together with the Written Opinion of the International Searching Authority, 11 Pages.

(Continued)

*Primary Examiner* — Chandrika Prasad
(74) *Attorney, Agent, or Firm* — Sunstein Kann Murphy & Timbers LLP

(57) ABSTRACT

A motor vehicle power conductor (1) is described and illustrated, in particular a battery conductor of a motor vehicle, having a first end (3) on the battery side and having a second end (4), wherein the motor vehicle power conductor (1) has a metallic flat conductor (2) and an insulation (8) enclosing the metallic flat conductor (2). In order to provide a connection means for a jump-start device in a simple and cost-effective way, it is proposed that the motor vehicle power conductor (1) is formed in one area as a jump-start connection point (5).

20 Claims, 4 Drawing Sheets

(56) References Cited

U.S. PATENT DOCUMENTS

Figure 1A:
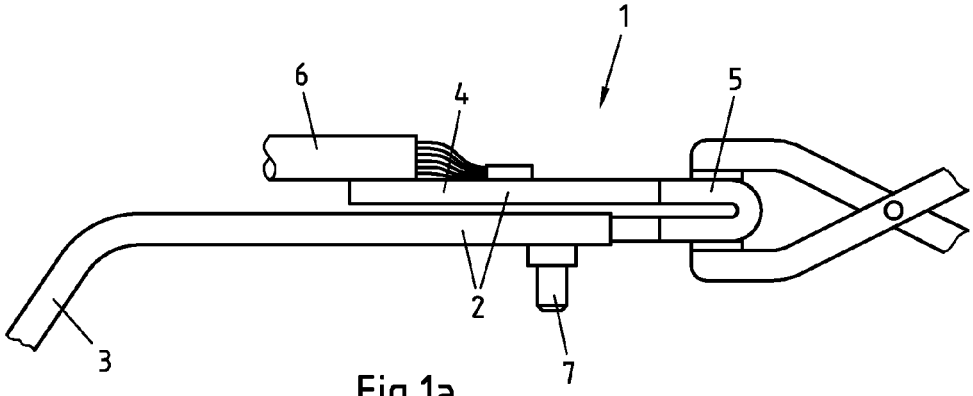

| | | | | |
|---|---|---|---|---|
| 5,921,809 | A * | 7/1999 | Fink | H01M 2/305 439/504 |
| 6,155,870 | A * | 12/2000 | Valentine | H01M 2/1072 439/501 |
| 6,638,101 | B1 * | 10/2003 | Botelho | H01R 11/24 439/188 |
| 6,913,483 | B2 * | 7/2005 | Restaino | G01R 1/02 439/504 |
| 8,850,748 | B2 | 10/2014 | Zimmermann et al. | 49/502 |
| 8,878,069 | B2 | 11/2014 | Kim et al. | 174/135 |
| 2005/0191898 | A1 * | 9/2005 | Shurden | H01R 11/24 439/504 |
| 2006/0223384 | A1 * | 10/2006 | Schuh | H01R 11/24 439/759 |
| 2008/0032188 | A1 * | 2/2008 | Kao | H01M 2/0207 429/162 |
| 2009/0104514 | A1 | 4/2009 | Lietz et al. | 429/121 |
| 2012/0228971 | A1 | 9/2012 | Bayer et al. | 310/71 |
| 2013/0161053 | A1 * | 6/2013 | Okamoto | H01M 2/206 174/68.1 |

FOREIGN PATENT DOCUMENTS

| | | | |
|---|---|---|---|
| CN | 102365802 A | 2/2012 | H02G 3/30 |
| CN | 102625975 A | 8/2012 | H02K 11/00 |
| DE | 74 40 606 | 5/1975 | B06R 18/02 |
| DE | 27 45 189 | 4/1979 | H01B 5/02 |
| DE | 199 06 000 | 8/2000 | B60R 16/02 |
| DE | 10 2006 049 604 | 4/2008 | H01B 13/012 |
| DE | 10 2006 050 705 | 4/2008 | H01B 7/08 |
| DE | 10 2007 025 268 | 12/2008 | H01R 13/03 |
| DE | 10 2008 032 854 | 1/2010 | H01B 13/08 |
| DE | 10 2009 051 487 | 6/2010 | B60R 16/03 |
| DE | 20 2011 001 995 | 6/2010 | B60R 16/04 |
| DE | 20 2011 001 995 | 6/2011 | B60R 16/04 |
| WO | WO 2006/051121 | 5/2006 | H01B 7/00 |
| WO | WO 2006/082238 | 8/2006 | H01B 7/08 |
| WO | WO 2007/019925 | 2/2007 | |

OTHER PUBLICATIONS

International Searching Authority, International Search Report—International Application No. PCT/EP2013/066072, dated Oct. 22, 2013, 3 Pages.

German Patent and Trademark Office, Office Action, Application No. 10 2012 015 350.3, dated Mar. 21, 2013, 6 pages.

International Bureau of WIPO, English translation of International Preliminary Report on Patentability—International Application No. PCT/EP2013/066072, dated Feb. 12, 2015, 5 Pages.

State Intellectual Property Office of P.R.C, Office Action: Notification of the First Office Action—Application No. 201380041881.5, dated Oct. 8, 2015, 3 pages.

State Intellectual Property Office of P.R.C, Office Action: Notification of the First Office Action— Application No. 201380041881.5, dated Oct. 8, 2015, 6 pages (English translation).

* cited by examiner

MOTOR VEHICLE POWER CONDUCTOR HAVING A METALLIC FLAT CONDUCTOR ENCLOSED BY AN INSULATION AND A BENT JUMP-START CONNECTION POINT

The subject matter relates to a motor vehicle power conductor, in particular a battery conductor of a motor vehicle, having a first end on the battery side and having a second end, wherein the motor vehicle power conductor has a metallic flat conductor and an insulation enclosing the metallic flat conductor. The subject matter also relates to the use of such a motor vehicle power conductor in a motor vehicle.

In modern motor vehicles, the installation space available for components, such as vehicle batteries, is limited. Therefore, it is often not possible to install the vehicle battery in such a way that it is easily accessible. However, access to the vehicle battery can be necessary if the battery is to be recharged or if the vehicle's own engine or the engine of a second vehicle has to be jump started by externally supplied electric power. In the case of batteries which are difficult to get access to, often components even have to be removed, in order to get to the battery. This is very laborious and partly requires special tools. Furthermore, in the case of a vehicle which is standing at the roadside due to a breakdown, uncovering the battery cannot always be done safely due to the traffic situation.

Recharging the battery or jump starting the vehicle is made more difficult by the battery terminals also being difficult to get access to in modern motor vehicles. As an example, modern cable clamps often have pyrotechnic separating devices which detach the cable clamp from the battery terminal in the case of a crash. In addition, often conventional cables are not used as power conductors, but rather electrical flat conductors. However, most terminal clips of jump-start devices are formed with a round cross-section on jump-start points of conventional battery cables, which is why connecting a terminal clip to a flat-strip conductor can be difficult.

A jump-start facility for a battery of a motor vehicle is known from DE 10 2009 051 487 A1. Here, it is proposed that a T-shaped support part is integrated into a flexible earth cable. A brass sleeve is screwed onto the support part, which forms the connection for a terminal clip of a jump-start device. Due to the flexibility of the earth cable, the jump-start connection point can be detached from a holder and turned into an accessible usage position.

The proposed solution has several disadvantages. Firstly, the solution can only be implemented in conjunction with conventional earth cables consisting of flexible stranded wires; the use of flat conductors with a larger cross-sectional area is difficult due to the higher rigidity. Furthermore, the production of the jump-start facility is complex, since a separate support part has to be integrated into the earth cable. Subsequently, the brass sleeve, which is also designed as a separate part, has to be screwed onto the support part.

A motor vehicle power conductor is known from DE 10 2007 025 268 A1, which can be formed as a flat conductor. It is proposed that as the jump-start connection point a connecting bolt is connected to the flat conductor. For this purpose, the connecting bolt on one end has a pin with a screw thread which can be screwed into a drill hole provided for this in the flat conductor.

The complex production is also a disadvantage with this solution. Since the connecting bolt is designed as a separate component and is to be screwed to the flat conductor, a screw thread has to be produced both in the flat conductor and on the connecting bolt. In addition, depending on the bolt material used, contact corrosion and loosening of the screwed connection can occur.

The subject matter is based on the object of developing and enhancing the motor vehicle power conductor, which has been described in the introduction and previously illustrated in more detail, in such a way that a connection point is provided for a jump-start device in a simple and cost-effective way.

In the case of a motor vehicle power conductor according to the preamble of Claim 1, the object is achieved by the motor vehicle power conductor being formed in one area as a jump-start connection point.

Motor vehicle power conductors are conductors which not only transfer signals or the like but are also suitable for transferring very high electric currents and outputs. Motor vehicle power conductors are in particular used as battery conductors, i.e. as a connection between a motor vehicle battery and a alternator/starter, and therefore have to have a very high current-carrying capacity. Charging currents or starting currents in vehicles are frequently 100 amps and more, often even several hundred amps. By forming a part of the motor vehicle power conductor itself as a jump-start connection point—i.e. as a contact point for connecting a jump-start device—separate connecting parts, such as bolts, sleeves or the like, can be dispensed with. Therefore, involved joining processes, which would be required for attaching separate parts, can also be dispensed with. A further advantage of an integrated and hence homogeneous jump-start connection point is that in contrast to separate connecting parts no contact corrosion can occur. The jump-start connection point can be formed as an uninsulated contact point by removing the insulation of the metallic flat conductor in a defined area. Alternatively, the metallic flat conductor during production can be left without insulation in a defined area. In this way, a jump-start facility, in particular a terminal clip or jump-start clip of a jump-start cable, can be directly connected to the bare metallic flat conductor.

According to a further embodiment, provision is made for the jump-start connection point to be arranged as a bare contact point between the first end and the second end of the motor vehicle power conductor. A bare contact point is a point where the metallic flat conductor is uninsulated and therefore directly accessible. With an arrangement between the first end and the second end of the motor vehicle power conductor, it can be understood that the jump-start connection point is arranged in the area of the direct and immediate connection between the first end and the second end of the motor vehicle power conductor and not in a branch or on a further arm. Vehicles are frequently equipped with a widely branched network of electric cables which is also called a cable harness. In modern vehicles, the cable harness can have a considerable bulk and complexity. This embodiment has the advantage that the motor vehicle power conductor does not have to have any further ends, arms or branches, so that the bulk and complexity of the wiring system is not increased further.

According to a further embodiment, it is proposed that the jump-start connection point is arranged between two adjacent insulated sections of the motor vehicle power conductor. By only removing the insulation of the motor vehicle power conductor locally in the area of the jump-start connection point, the jump-start connection point can be arranged at almost any point on a motor vehicle power conductor. Although the insulation can be completely removed, it is not necessary to do this. It is equally possible, although it is not necessary, to completely remove the insulation from the jump-start connection point as far as one end of the motor vehicle power conductor.

An alternative embodiment makes provision for the first end and/or the second end to be a free end and for the motor vehicle power conductor to be formed as a jump-start connection point in the area of the first end and/or of the second end. A free end is understood as an area of the motor vehicle power conductor, to which no generator or consumer is connected. A free end can be designated for connecting a jump-start device.

According to a further embodiment, provision is made for the metallic flat conductor to be U-shaped in the area of the jump-start connection point. The flat conductor can equally be hook-shaped or bent in the shape of an S or Z in the area of the jump-start connection point. Flat conductors are frequently characterised by a cross-section with a low height and a considerably greater width. Connecting a terminal clip of a jump-start device can be difficult as a result of this cross-section shape. Standard terminal clips have a metal spring, the clamping force of which increases as the opening angle of the terminal clip increases. In other words, the clamping force of the terminal clip is low when the terminal clip is only slightly opened. When the terminal clip is opened very widely the clamping force is high. With flat conductors, the problem can occur that the low height of the flat conductor produces a clamping force in the terminal clip which is too low. Therefore, particularly when it is damp or if there are vibrations, there is the risk that the terminal clip will slip off from the jump-start support point. In contrast, the great width of flat conductors results in the terminal clip being very difficult to attach, since the opening angle of terminal clips is structurally limited. This problem can be solved by deforming the motor vehicle conductor cable in the area of the jump-start connection point, in particular by bending it, so that a U-shaped contact point is formed. A U-shape is in particular understood to be a shape, in which the metallic flat conductor is bent, for example, by at least 180°. In this way, the jump-start connection point can have a clamping width which is greater than the height of the flat conductor, but which is less than the width of the flat conductor. Hence, the terminal clip can be more securely held by means of a U-shaped jump-start connection point. There is neither the risk that the clamping force will be too low nor the risk that the terminal clip cannot be opened wide enough.

An alternative embodiment makes provision for the motor vehicle power conductor to have a third free end and for the motor vehicle power conductor to be formed as a jump-start connection point in the area of the third free end. By providing a third free end, and hence a branch, the jump-start connection point can be arranged more flexibly in the engine bay. Particularly in the case of motor vehicle power conductors which are arranged in a place which is difficult to reach, it is more convenient to lead a free end to an accessible place in the vehicle than to lead the entire motor vehicle power conductor like a loop to this place and back again. In particular, the end area of the free end can be formed as a jump-start connection point. The free end can branch off from the direct connection between the first end and the second end or, for example, from a potential strip.

According to a further embodiment, good electrical conductivity can be achieved by the metallic flat conductor being made from aluminium or copper. Furthermore, aluminium has the advantage that it has a particularly low density, whereby the mass of the motor vehicle power conductor can be reduced. Pure aluminium 99.5% EN AW1050A or 99.7% EN AW1070A have proved to be particularly suitable due to a very good conductivity.

According to a further embodiment, the metallic flat conductor has a rectangular cross-section. Rectangular profiles can be produced particularly easily and hence economically. A particularly high flexibility can be obtained for the metallic flat conductor if the height of the flat conductor is particularly low in relation to its width. Width/height ratios of 2 to 1 to 12 to 1 have proved successful in practice; width/height ratios of 2.5 to 1 to 6 to 1 are preferred. In particular in the case of flat conductors made from aluminium, the width of the metallic flat conductor can be at least three times as great as its height, so that the quotient from the width of the metallic flat conductor and the height of the metallic flat conductor is greater than or equal to three. For use in motor vehicles, a height between 2.5 mm and 8 mm and a width between 8 mm and 30 mm have proved suitable. Preferably, the cross-sectional area in the case of aluminium flat conductors lies in the range between 16 $mm^2$ and 160 $mm^2$, in particular in the range between 50 $mm^2$ and 120 $mm^2$. In the case of copper flat conductors, cross-sectional areas in the range between 30 $mm^2$ and 75 $mm^2$ are preferred.

A further embodiment makes provision for the cross-sectional area of the metallic flat conductor in the area of the jump start connection point to be the same as or less than in the remaining areas of the metallic flat conductor. The advantage of a smaller cross-sectional area is a better contact between the jump-start clip and the flat conductor. An identical cross-sectional area has the advantage of a constant electric current conductivity and uniform heating.

In a further embodiment, the width of the metallic flat conductor in the area of the jump start connection point is the same as or less than in the remaining areas of the metallic flat conductor. By only reducing the width and not the height of the metallic flat conductor in the area of the jump-start support point, the difference is less between the width and the height of the metallic flat conductor. The width can preferably be reduced to the extent that the width and the height of the metallic flat conductor in the area of the jump-start connection point is approximately identical. In other words, the cross-sectional area of the metallic flat conductor can be quadratic in the area of the jump-start connection point. By reducing the width of the metallic flat conductor in the area of the jump-start connection point, an optimum clamping force can be achieved irrespective of from which side or from which direction a terminal clip is connected. A reduction in the width of the metallic flat conductor in the area of the jump-start connection point of at least 8 mm, in particular of 10 mm, has proved particularly suitable. An identical width has the advantage of a constant electric current conductivity and uniform heating.

According to a further embodiment, provision is made for the motor vehicle power conductor to have a removable electrically insulating cover in the area of the jump-start connection point. By means of an electrically insulating cover, the jump-start connection point is protected from an accidental contact and an associated short circuit. Preferably, the cover also provides protection against dust and moisture. The cover can be removed, so that a jump-start device can be connected to the jump-start connection point. Preferably, the cover can be removed manually, i.e. without using a tool.

An advantageous further embodiment makes provision for the cover to be designed as a protective cap, in particular as a pivotable protective cap made for plastic. A pivotable protective cap has the advantage that the protective cap can be swung open and closed again without it falling into the engine bay or onto the floor. The protective cap is hence durably connected to the motor vehicle power conductor. The connection can be formed by a film hinge or a hinged joint. The use of plastic has the advantage that it has very good electrical insulation properties and can be produced cheaply, for example by injection moulding.

A jump-start device can be particularly easily and safely connected by the cover, according to a further embodiment, having an identification of the polarity, in particular a colour marking and/or a symbol. By identifying the polarity, for instance with a plus or minus symbol, even people with little experience can reliably recognise whether the positive or the negative terminal has to be connected to the jump-start connection point. Often, starter cables are also identified in terms of colour, wherein the cable for the positive terminal is red and the cable for the negative terminal is black. Alternatively or in addition to the symbols, the cover can therefore preferably also have a red or black colour marking.

The previously described motor vehicle power conductors can be used in a motor vehicle. In particular, the motor vehicle power conductors can be used as battery conductors, for instance as a B+ battery conductor for a motor vehicle.

The features of the methods and devices can be freely combined with one another. In particular, features and partial features of the description and/or of the dependent and independent claims, even when features or partial features of the independent claims are fully or partially bypassed, can be inventive in their own right in isolation or freely combined with one another.

The subject matter is explained in more detail below with the aid of the figures merely illustrating a preferred exemplary embodiment.

Figure 1B:
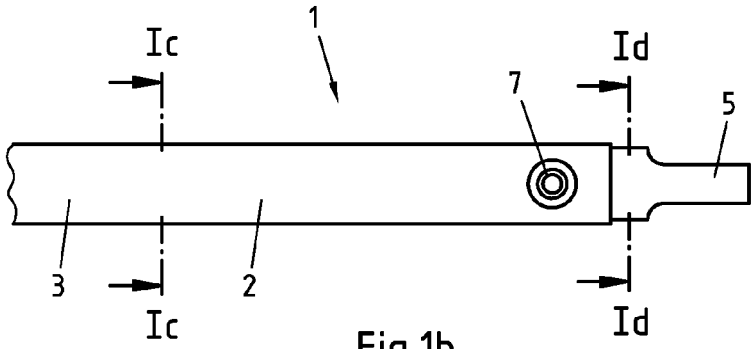
Figure 1C:
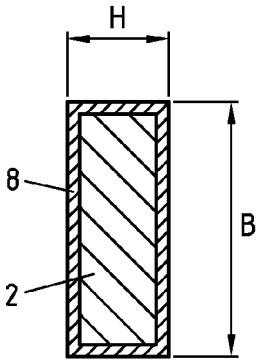

FIG. 1*a* shows a motor vehicle power conductor according to the invention in a side view;

FIG. 1*b* shows the motor vehicle power conductor from FIG. 1*a* in a plan view;

FIG. 1*c* shows a sectional view of the motor vehicle power conductor along the line Ic-Ic from FIG. 1*b;*

Figure 1D:
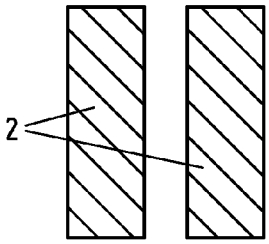

FIG. 1*d* shows a sectional view of the motor vehicle power conductor along the line Id-Id from FIG. 1*b;*

Figure 2A:
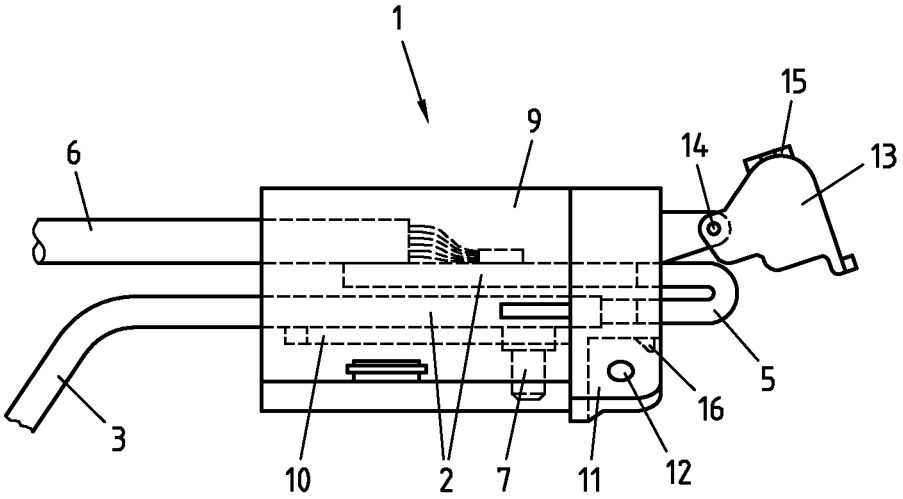
Figure 2B:
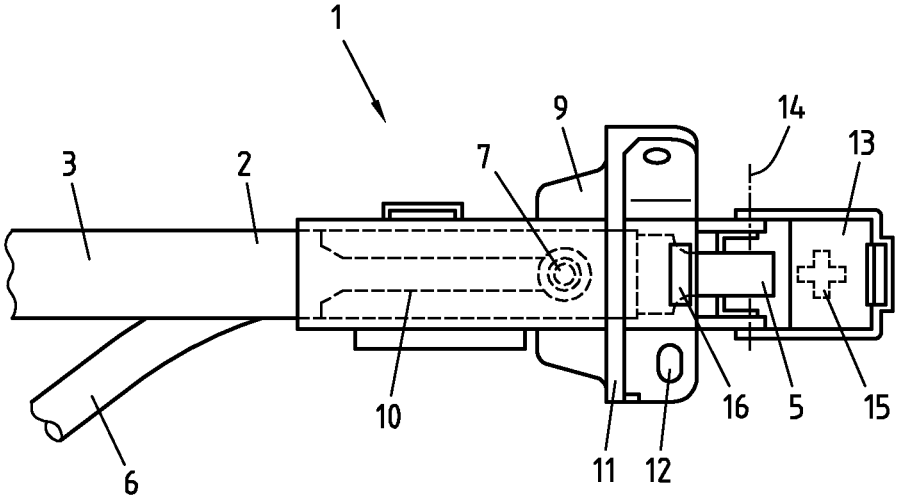
Figure 3A:
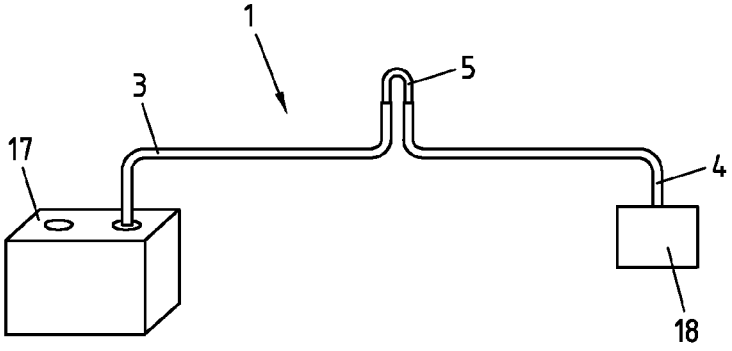
Figure 3B:
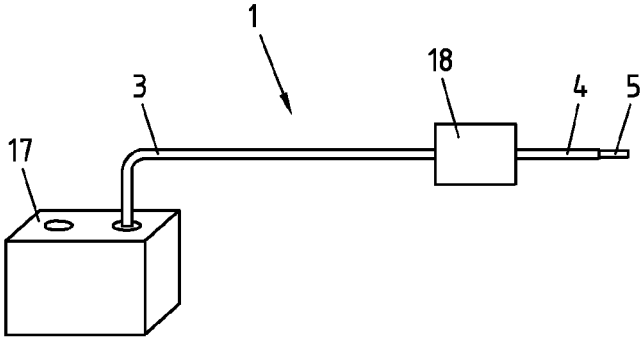
Figure 3C:
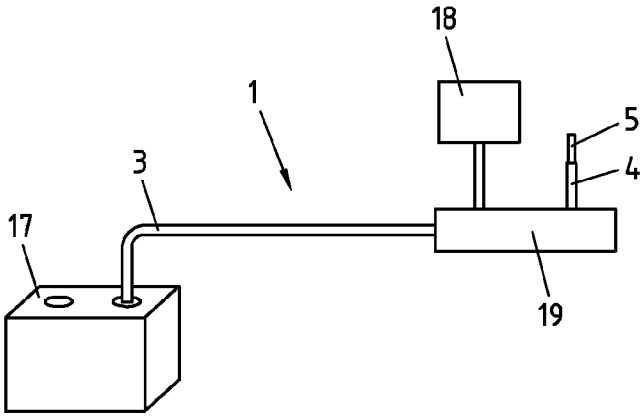
Figure 3D:
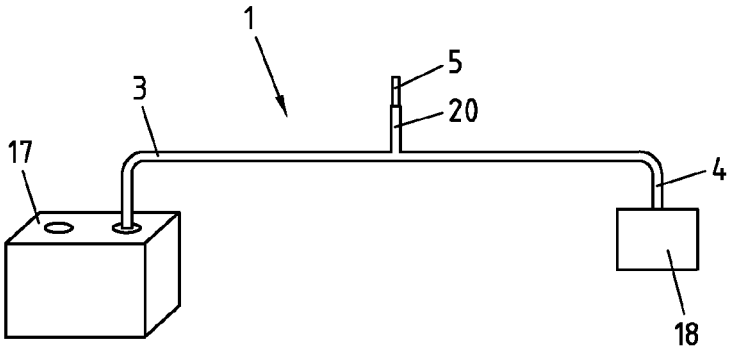
Figure 4A:
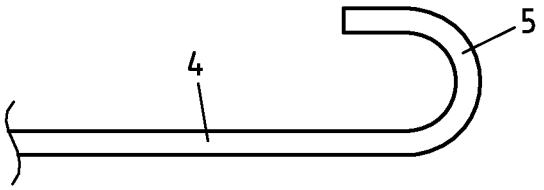
Figure 4B:
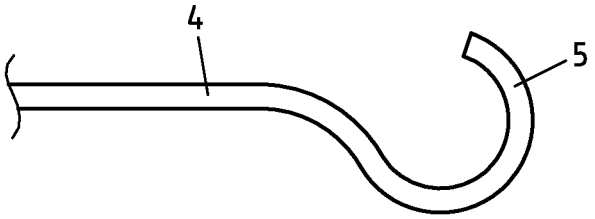
Figure 4C:
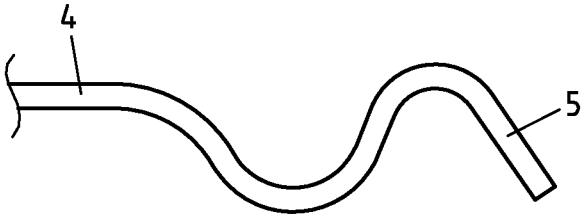

FIG. 2*a* shows the motor vehicle power conductor from FIG. 1*a* with an attached housing in a side view;

FIG. 2*b* shows the motor vehicle power conductor from FIG. 1*b* with an attached housing in a plan view;

FIGS. 3*a*-3*d* show various embodiments of a motor vehicle power conductor with a jump-start connection point in schematic illustration and FIGS. 4*a*-4*c* show various embodiments of a jump-start connection point.

A motor vehicle power conductor 1 is shown in a side view in FIG. 1*a*. The illustrated motor vehicle power conductor 1 has a metallic flat conductor 2 with a first end 3 on the battery side and a second end 4. The second end 4 can be assigned to an on-board power supply, to a consumer or to a generator. Between the two ends 3, 4, one part of the metallic flat conductor 2 is formed as a jump-start connection point 5 for connecting a terminal clip of a jump-start device schematically illustrated in in FIG. 1*a*. A cable 6 is attached to the second end 4 of the metallic flat conductor 2 by welding. In addition, the metallic flat conductor 2 has a bolt 7 which serves to secure a housing which is not illustrated in FIG. 1*a*. The end 4 can also be on the battery side and the cable 6 can, for example, be the cable leading to the cable clamp. Then, the end 3 is on the consumer side. The end 4 can also be a free end, as shown in FIG. 3*b* and in FIG. 3*c*.

FIG. 1*b* shows the motor vehicle power conductor 1 from FIG. 1*a* in a plan view. The metallic flat conductor 2 is illustrated from the side of the first battery-side end 3. The transition from the insulated area of the metal flat conductor 2 to the uninsulated, bare jump-start connection point 5 of the metallic flat conductor 2 is illustrated by a step. The bolt 7 has a cylindrical cross-section in the exemplary embodiment which is illustrated in FIG. 1*b* and is insofar preferred. The bolt 7 is made from metal and it is welded to the metallic flat conductor 2.

A sectional view of the motor vehicle power conductor 1 along the line Ic-Ic from FIG. 1*b* is illustrated in FIG. 1*c*. The metallic flat conductor 2 forms the core of the motor vehicle power conductor 1. The metallic flat conductor 2 is completely enclosed by an insulation 8 which is preferably produced from plastic. FIG. 1*d* in contrast shows a sectional view of the motor vehicle power conductor along the line Id-Id from FIG. 1*b*. As can be identified in FIG. 1*b*, the line Id-Id lies in the area of the uninsulated jump-start connection point 5, so that in the sectional view in FIG. 1*d* the metallic flat conductor 2 is formed bare and in particular is formed without insulation. In this way, an electrical connection can be produced between the terminal clip of a jump-start device and the metallic flat conductor 2.

FIG. 2*a* shows the motor vehicle power conductor 1 from FIG. 1*a* with an attached housing 9 in a side view. The housing 9 is made from plastic and is connected to the metallic flat conductor 2 by pushing the bolt 7 into a holding recess 10 provided in the housing 9. The holding recess 10 is also produced from plastic and is flexible. The bolt 7 locks in place at the end of the holding recess 10, so that a releasable form-fit snap connection is formed. The housing 9 has a flange 11 with drill holes 12. The housing 9 can be fixed via the drill holes 12 to a place in the engine bay of a vehicle which is easy to reach. In this way, it can be ensured that the jump-start connection point 5 is always easily accessible. Finally, the housing 9 has a protective cap 13. The protective cap 13 is connected to the housing 9 and can be pivoted about a pivot pin 14, so that the jump-start connection point 5 is easily accessible when the protective cap 13 is open and is protected against dust and moisture when the protective cap 13 is closed. The protective cap 13 has an identification 15 of the polarity, here a plus symbol. This makes connection of the correct terminal clip easier, since the vehicle battery does not have to be located in close proximity to the motor vehicle power conductor 1 and in which case the polarity of the vehicle battery can be difficult to identify. The protective cap 13 can form a releasable snap connection with a snap hook 16 provided on the housing 9.

The motor vehicle power conductor 1 from FIG. 1*b* with an attached housing 9 is illustrated in a plan view in FIG. 2*b*. The reference symbols in FIG. 2*b* and the elements indicated by them correspond to FIG. 2*a*.

FIGS. 3*a* to 3*d* show various embodiments of a motor vehicle power cable 1 with a jump-start support point 5 in schematic illustration.

FIG. 3*a* shows a motor vehicle power conductor 1 with a jump-start connection point 5 which is arranged between the first end 3 on the battery side and the second end 4 of the motor vehicle power conductor 1. The first end 3 is connected to a terminal of a vehicle battery 17, while the second end 4 is connected to a consumer or generator 18. The consumer or generator 18 can, for example, be a starter or an alternator. The motor vehicle power conductor 1 forms a U-shaped loop between the first end 3 and the second end 4 in the area of the jump-start connection point 5.

In contrast, as an alternative embodiment FIG. 3*b* shows a motor vehicle power conductor 1 with a jump-start connection point 5 which is arranged on a free end of the motor vehicle power conductor 1. The second end 4 is formed as the free end and projects beyond the connection point of the consumer or generator 18 on the motor vehicle power conductor 1. In other words, the second free end 4 constitutes an extension of the motor vehicle power conductor 1. The first end 3 is connected to a terminal of the vehicle battery 17, as in FIG. 3*a*.

In FIG. 3*c*, the second free end 4 of the motor vehicle power conductor 1 branches off from a potential bar 19, to which the consumer or generator 18 is also attached. The first end 3 is connected to a terminal of the vehicle battery 17, as in FIG. 3*a*.

FIG. 3*d* shows a motor vehicle power conductor 1 which has a third free end 20, and in which the motor vehicle power conductor 1 is formed as a jump-start connection point 5 in the area of the third free end 20. The free third end 20 branches off from the direct connection between the first end 3 and the second end 4 of the motor vehicle power conductor 1. The first end 3 of the motor vehicle power conductor 1 is also connected to a terminal of the vehicle battery 17 in FIG. 3*d*. The second end 4 is connected to the consumer or generator 18.

In FIGS. 4*a* to 4*c*, various embodiments of a jump-start connection point 5 are illustrated. FIG. 4*a* shows a U-shaped embodiment of the jump-start connection point 5. In contrast, FIG. 4*b* shows a hook-shaped embodiment of the jump-start connection point 5. Finally, FIG. 4*c* shows an S-shaped or Z-shaped embodiment of the jump-start connection point 5. In all three of the variants illustrated in FIGS. 4*a* to 4*c*, the jump-start connection point 5 is arranged on the free end 4 of a motor vehicle power conductor 1, so that these embodiments of the jump-start connection points 5 can be assigned to the motor vehicle power conductor 1 from FIGS. 3*b* to 3*d*. In addition to the embodiments illustrated in FIGS. 4*a* to 4*c*, a deformation of the motor vehicle power conductor 1 can also be dispensed with, so that the motor vehicle power conductor 1 can be formed straight in the area of the jump-start connection point 5.

The invention claimed is:

1. A motor vehicle power conductor comprising:

a battery conductor having a first end on a battery side, and having a second end, wherein the battery conductor includes a metallic flat conductor and an insulation enclosing the metallic flat conductor along a substantial portion of its length; and, a bent jump-start connection point formed in the area of the second end of the battery conductor arranged so as to leave the second end as a free end.

2. Motor vehicle power conductor according to claim 1, wherein the jump-start connection point is arranged as a bare contact point between the first end and the second end of the battery conductor.

3. Motor vehicle power conductor according to claim 2, wherein the jump-start connection point is arranged between two adjacent insulated sections of the battery conductor.

4. Motor vehicle power conductor according to claim 1, wherein the metallic flat conductor is U-shaped in the area of the jump-start connection point.

5. Motor vehicle power conductor according to claim 1, wherein the motor vehicle power conductor has a third end, said third end being a free end, and wherein the jump-start connection point is formed by the third free end.

6. Motor vehicle power conductor according to claim 1, wherein the metallic flat conductor is made from aluminium or copper.

7. Motor vehicle power conductor according to claim 1, wherein the metallic flat conductor has a rectangular cross-section.

8. Motor vehicle power conductor according to claim 7, wherein Q>=3 applies for the quotient (Q) from the width (B) of the metallic flat conductor and the height (H) of the metallic flat conductor.

9. Motor vehicle power conductor according to claim 1, wherein the cross-sectional area of the metallic flat conductor in the area of the jump start connection point is the same as or less than in an area of the metallic flat conductor abutting on the jump-start connection point.

10. Motor vehicle power conductor according to claim 1, wherein the width (B) of the metallic flat conductor in the area of the jump-start connection point is the same as or less than in an area of the metallic flat conductor abutting on the jump-start connection point.

11. Motor vehicle power conductor according to claim 1, wherein the battery conductor has a removable, electrically insulating cover in the area of the jump-start connection point.

12. Motor vehicle power conductor according to claim 11, wherein the cover is designed as a pivotable protective cap made from plastic.

13. Motor vehicle power conductor according to claim 11, wherein the cover has an identification of the polarity, in particular, a color marking and/or a symbol.

14. A motor vehicle comprising:

a battery; and a motor vehicle power conductor according to claim 1 with its first end connected to the battery.

15. Motor vehicle power conductor according to claim 3, wherein the metallic flat conductor is U-shaped in the area of the jump-start connection point.

16. Motor vehicle power conductor according to claim 4, wherein the metallic flat conductor has a rectangular cross-section.

17. Motor vehicle power conductor according to claim 4, wherein the battery conductor has a removable, electrically insulating cover in the area of the jump-start connection point.

18. Motor vehicle power conductor according to claim 7, wherein the battery conductor has a removable, electrically insulating cover in the area of the jump-start connection point.

19. Motor vehicle power conductor according to claim 15, wherein the battery conductor has a removable, electrically insulating cover in the area of the jump-start connection point.

20. Motor vehicle power conductor according to claim 16, wherein the battery conductor has a removable, electrically insulating cover in the area of the jump-start connection point.

* * * * *